US005348430A

United States Patent [19]

Metz et al.

[11] Patent Number: 5,348,430

[45] Date of Patent: Sep. 20, 1994

[54] UNIVERSAL CHUCK FOR A MACHINE FOR PIERCING A TAP HOLE OF A SHAFT FURNACE

[75] Inventors: Jean Metz, Luxembourg; Patrick Millen, Fennange; Henri Radoux, Bereldange; Fernand Roemen, Luxembourg-Cents, all of Luxembourg

[73] Assignee: Paul Wurth S.A., Luxembourg

[21] Appl. No.: 76,350

[22] Filed: Jun. 10, 1993

[30] Foreign Application Priority Data

Jun. 10, 1992 [LU] Luxembourg ..... 88 129

[51] Int. Cl.[5] ..... B23B 31/10

[52] U.S. Cl. ..... 408/239 R; 266/271; 279/19; 279/19.5

[58] Field of Search ..... 408/238, 239 R; 279/19, 279/19.5, 19.6, 127, 137, 4.04, 4.11, 20; 266/45, 271

[56] References Cited

U.S. PATENT DOCUMENTS

| | | | |
|---|---|---|---|
| 3,862,750 | 1/1975 | Broom . | |
| 4,284,284 | 8/1981 | Sides | 279/19.5 |
| 4,775,159 | 10/1988 | Manschitz | 279/19.5 |
| 5,039,068 | 8/1991 | Venturini et al. | 266/271 |

FOREIGN PATENT DOCUMENTS

| | | | |
|---|---|---|---|
| 0025423 | 3/1981 | European Pat. Off. . | |
| 0405207 | 2/1991 | European Pat. Off. . | |
| 456003 | 11/1991 | European Pat. Off. | 408/226 |
| 3828309 | 2/1990 | Fed. Rep. of Germany | 279/19.5 |
| 2520857 | 5/1983 | France . | |
| 2621264 | 4/1989 | France . | |

*Primary Examiner*—Daniel W. Howell

*Attorney, Agent, or Firm*—Fishman, Dionne & Cantor

[57] ABSTRACT

A universal chuck is presented which has the ability to either transmit a tensile or pulling force to the end of a piercing rod or transmit a rotational moment or force to a drill bit on a piercing machine for piercing a tap hole of a shaft furnace. The universal chuck of this invention comprises a rotary body mounted on the drive spindle of a working member slidably mounted on a piercing machine. A suitable support structure integral with the working member forms a guide cage around the rotary body. Structure for transmitting the tensile or pulling force to the end of a piercing rod and a rotational moment or force to a drill bit along with structure for adequately controlling operating and cooling fluids to a drill bit are arranged about a front cavity in the rotary body.

13 Claims, 7 Drawing Sheets

UNIVERSAL CHUCK FOR A MACHINE FOR PIERCING A TAP HOLE OF A SHAFT FURNACE

BACKGROUND OF THE INVENTION

The present invention relates generally to a new and improved universal chuck for a machine for piercing a taphole of a shaft furnace. More particularly, this invention relates to an improved universal chuck capable of both transmitting a tensile or pulling force to the end of a piercing rod and a rotational moment or force to a drill bit.

It is known that the taphole of a shaft furnace can be pierced either by normal drilling or by the lost rod method.

In normal drilling, a drill bit is driven in rotation by a working member mounted on a mount which is aligned with the axis of the tap hole. This method consequently employs a drill bit, which cuts in rotation and which is coupled to the spindle of the working member in order to make the tap hole. The drill bit is usually equipped with an axial channel which traverses it longitudinally and which enables pressurized air to be conveyed to the tip of the drill so as to effect a better removal of the waste fragments from the drilling and also cool the tip of the drill bit. The device may be a chuck which is fairly simple, and of light weight construction screwed to the spindle of the working member, which enables a rotational moment to be transmitted to the drill bit.

In the lost rod method, after the tap hole has been sealed with a plugging compound, but before the taphole clay has completely hardened, a metal rod is inserted into the tap hole. When the tap hole needs to be opened, the rod is extracted to form an opening in the hardened plugging compound. To extract the rod from the tap hole, it is known to equip the working member of a piercing machine with a special coupling device for firmly joining the free end of the rod to the working member. An axial tensile force is thus transmitted to the rod usually via the blows of a hammer which forms an integral part of the working member.

Such special coupling devices are disclosed, for example in Luxembourg Patent LU-83,917, filed on Feb. 3, 1983 and Luxembourg Patent LU-87,546, filed on Jun. 30, 1989 (corresponding to U.S. Pat. No. 5,056,968), both of which are assigned to the assignee hereof, all of the contents of which are incorporated herein by reference. The two documents provide clamps which can be screwed to the threaded spindle of the working member. They comprise a body equipped with a front bore intended to receive the free end of the piercing rod and two movable jaws which are arranged symmetrically about this front bore and which can be displaced under the action of pneumatic jacks to grip the said free end.

These clamps are, however, not designed to transmit a rotational moment to a drill bit. Indeed, the rotating of the clamp to transmit a substantial moment to a drill bit held between the jaws would inevitably damage the clamp. It must also be remembered that the aforementioned clamp is supported at only one of its ends by the spindle of the working member, and that the clamp weighs approximately 50 kg. In other words, the clamp is much heavier than the chuck generally used to drive the drill bit. Therefore, it would appear to be impossible to rotate the clamp at 150 revolutions per minute to drive a drill bit.

It was also noted that the clamp was often subjected to forces which were offset relative to the axis of the spindle when the lost rod method was applied. These offset forces induce unacceptable bending moments in the spindle and in the mechanism of the working member.

To overcome this problem, a mounting device has been proposed in Luxembourg Patent LU-87,010, filed on Oct. 6, 1987 (corresponding to U.S. Pat. No. 4,893,794), assigned to the assignee hereof, all of the contents of which are incorporated herein by reference, in the form of a cage which allows a clamp, of the same type as those described in Luxembourg Patents LU-83,917 and LU-87,546, to be fixed rigidly on a carriage supporting the working member on the support body. This cage blocks any rotation of the clamp and prevents the spindle from being subjected to a bending moment caused by offset forces. Furthermore, the device of patent LU-87,010 facilitates the assembling and disassembling of the clamp on the threaded spindle of the working member.

The ease with which the clamp is mounted is an important aspect as the clamp must be disassembled when the working member needs to be used for working with a drill bit, and the clamp must be remounted later if a piercing rod needs to be extracted from the tap hole using the same working member. Even with the mounting device of patent LU-87,010, the exchanging of the clamp for a drilling chuck and vice versa is extremely hard manual work and takes a lot of time which, in addition exposes workers to the risk of accidents.

It would therefore be desirable to provide a design for a very rigid universal chuck which would transmit hardly any of the offset forces to which it is subjected to the spindle and would allow a tensile/percussive force to be transmitted to the end of a piercing rod or transmit a substantial moment of rotation or force to a drill bit.

Such offset forces appear, in particular, when the piercing machine is withdrawn from the tap hole, while the rod is still not entirely free of the tap hole. It is often necessary to make such an early movement of the piercing machine away from its working position towards its withdrawn position. This is done in order to prevent the machine from being splashed by the jet of molten metal, which may occur when the tap hole is opened.

It should be noted that the chuck according to the present invention also overcomes a problem of the mounting device according to patent LU-87,010. This device blocks any rotation of the clamp although the working member can still be operated to produce a rotational moment. As a result, the spindle and certain elements of the mechanism of the working member are subjected to a maximum torsional force when the operator inadvertently initiates the rotational movement. This maximum torsional force is added to the normal stresses which occur when the rod is inserted and extracted, resulting in increased fatigue of the elements of the working member.

SUMMARY OF THE INVENTION

The above-discussed and other drawbacks and deficiencies of the prior art are overcome or alleviated by the universal chuck for a machine for piercing a tap hole of a shaft furnace of the present invention. In accordance with the universal chuck of the present invention, a piercing machine comprising a working member equipped with a spindle defining a longitudinal axis O, is mounted on a sliding carriage of the piercing machine.

The working member is capable of generating at least a rotational moment about the axis O and a tensile/percussive force along the axis O. The universal chuck comprises an oblong body equipped with means for making the oblong body axially integral with the spindle, and at the opposite end with a front cavity arranged about the axis O in such a way as to permit the insertion therein of one end of a drill bit, or alternatively, a piercing rod.

The basic elements of this universal chuck comprise an oblong body equipped at one end of the oblong body with means for making the chuck axially integral with the working member spindle and at the opposite end with a front cavity. This front cavity is arranged about the axis O in such a way as to permit the insertion therein of one end of a drill bit, or alternatively, the end of a piercing rod. This chuck is designed with a first means for gripping the end of a piercing rod in the front cavity which allows a sufficient tensile/percussive force to be transmitted to the piercing rod. A second means is provided to immobilize the end of a drill bit in the front cavity. This enables a rotational moment to be transmitted to the drill bit. Both means are arranged in the oblong body around the front cavity in a rigid structure fixed to the sliding carriage. This structure extends along the oblong body integral with the spindle. At least one bearing in this support structure supports and guides the oblong body radially while at the same time permits rotational movement about the axis O and relative axial sliding movement of the oblong body.

The use of the universal chuck of the present invention on a machine for piercing a tap hole dispenses with the need for exchanging the clamp which is used to extract a piercing rod for a drilling chuck when it is desired or required to drill the tap hole with a tool or bit which cuts in rotation. Indeed, the end of the drill simply needs to be inserted into the front cavity of the rotating body and immobilized to transmit the rotational moment to the drill bit. To extract a piercing rod from a tap hole, the end of the rod is inserted into the same front cavity where the rod is gripped by the aforementioned gripping means to transmit the tensile/percussive force to the rod.

It should be reiterated that a major feature of the present invention is that the rotary body integrally connected to the spindle of the working member is guided radially by at least one bearing. This bearing is mounted in a rigid support structure fixed to the sliding carriage of the working member. This mounting arrangement permits rotation of the rotary body allowing for both the transmission of an axial tensile force to a piercing rod and a rotation moment to a drill bit. In addition, this design permits sufficient axial travel of the rotary body that allows transmission of a percussive force. Furthermore, this mounting arrangement gives the chuck sufficient rigidity when used in the application of the lost rod method. Indeed, the offset forces that develop in this method do not generate bending moments at the spindle. This is because the support for the chuck is no longer a cantilevered support.

In a preferred embodiment, the means transmitting the tensile/percussive force to the piercing rod comprise at least two movable jaws arranged symmetrically about the axis O and which are capable of being displaced. This displacement takes place under the action of actuators (supplied with a pneumatic fluid), between a retracted position and an advanced position in which the said distance is less than the diameter of the rod. In the retracted position, the distance between the jaws, measured perpendicularly to the axis O, is greater than the largest of the diameters of the rod and of the drill bit.

The longitudinal axes of the actuators preferably form an angle of between 10 degrees and 20 degrees with the axis of rotation. This allows the end of the rod to be gripped firmly and at the same time reduces the overall diametrical size of the chuck. The actuators preferably comprise a return spring which restores the jaws to a retracted position against an abutment surface in the absence of pneumatic pressure.

The means for transmitting the rotational moment to the drill bit comprise a transverse key which is guided in transverse grooves formed in the rotary body and which interacts with a flat surface formed in the end of the drill bit. This is a simple and effective embodiment for locking in rotation the end of the drill bit in the said rotary body.

The present invention provides a removable sleeve which is inserted axially into the rotary cavity in order to immobilize the jaws in a retracted position against an abutment. The purpose of this sleeve, which is immobilized axially by the aforementioned transverse key locking the end of the drill bit in rotation, is to prevent the jaws from being able to move under the effect of the blows of the hammer during the drilling. Indeed, during the drilling, the jaws are subjected only to the action of the return spring which holds them in a retracted position against an abutment. If there were no sleeve, the blows of the hammer would cause the jaws to project beyond the end of the drill bit regardless of the presence of the return spring; as a result, the jaws would be hammered and become damaged. It will be appreciated that this sleeve can be used to an advantage, when a piercing rod is inserted into the plugging compound using the hammer. In this case, the universal chuck serves purely as a ram transmitting the blows of the hammer to the end of the rod which is simply inserted into the rotary cavity without the use of the means for gripping the end of the rod. Another advantage of this sleeve is that the sleeve effectively protects the jaws in cases where molten iron would have penetrated into the front rotary cavity. Indeed, it should be stressed that this risk is particularly great when drilling the tap hole since as soon as the drill bit has pierced the hole, the molten iron begins to spurt from the tap hole and reasonably large splashes penetrate inside the rotary cavity of the chuck, which is still situated near the tap hole. These splashes may then jam the jaws. This risk is effectively eliminated by the use of the sleeve which is equipped to one of its ends with a coaxial ring which radially seals the rotary cavity around the drill bit.

In a preferred embodiment, the support structure, integral with the sliding carriage, forms a cage surrounding the rotary body over the majority of its length. This cage preferably comprises a front plate and a rear plate, each equipped with a sleeve. A first and a second cylindrical bearing surface of the rotary body fit respectively into these two sleeves. These two sleeves define the bearing in which the rotary body can rotate and slide axially via the first and second cylindrical bearing surface of the rotary body fit respectively into these two sleeves. The cage comprises slides which interact with a central cylindrical bearing surface of the rotary body. This embodiment of the chuck has a particularly simple construction. At the same time this design provides the chuck with sufficient rigidity which effectively prevents the spindle and the working member from being damaged, even when substantial offset forces are applied. In addition, this embodiment provides excellent running conditions for the rotary body and allows it to slide axially when appropriate. Indeed, an axial sliding of small amplitude of the rotary body is necessary for the operation of a hammer incorporated into the working member.

The front plate is preferably fixed to the cage by bolts and can be removed in order to extract said rotary body from the cage. This feature permits easy maintenance of the chuck since the rotary body can easily be changed for a spare rotary body, and the slide and the sleeves of the bearings are easily accessible, facilitating their quick replacement.

The present invention also overcomes the problem of supplying either the pneumatic actuators for the jaws or the drill bit with a single pneumatic fluid supply duct. Indeed, it should be noted that the pneumatic fluid, conveyed through an axial duct in the drill bit to the head of the drill bit, is used in a drilling operation as a fluid for rinsing the tap hole and as a fluid for cooling the head. This preferred embodiment of the chuck comprises a supply channel in the spindle, and a first channel for distributing the pneumatic fluid to the actuators of the jaws. A second channel for distributing the pneumatic fluid opens out axially in one surface of the rotary cavity on which the end of the drill bit bears. A three-way valve incorporated into the rotary body enables the supply duct to be connected either to the first distribution channel or to the second distribution channel.

It will be appreciated by a person skilled in the art that the present invention provides particularly simple embodiments of a three-wave valve which can be easily incorporated into the rotary body for directing the pneumatic fluid either to the actuators or to the drill bit. It will be noted that the sealing surfaces in this three-way valve are essentially plane surfaces, which is ideal for obtaining good sealing efficiency utilizing simple means.

The chuck according to the present invention can also be used for rotating a rod when the latter is being inserted into the plugging compound, before the plugging compound has completely hardened. Indeed, it has been noted that rotating the rod in this way when it is inserted into the compound makes it possible to reduce substantially the axial force which needs to be applied to the rod in order to cause the rod to penetrate into the plugging compound. It will be noted that, in this case, the rod can either be held by the jaws, the torque needed to be transmitted for the rotation being relatively small,or by the transverse key. The rotation can, of course, also be an oscillatory movement about the longitudinal axis of the rod.

The above discussed and other features and advantages of the present invention will be appreciated and understood by those skilled in the art from the following description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
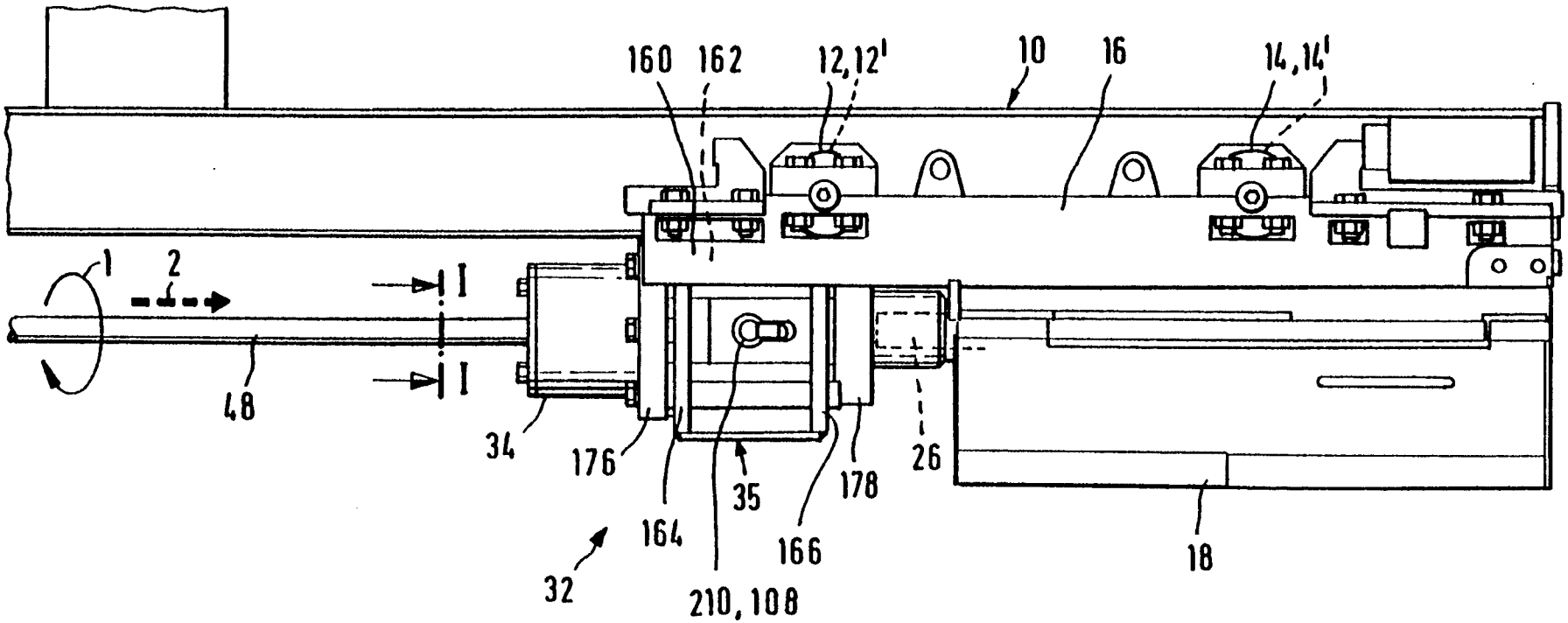
FIG. 1 is a side view of part of the mount of a machine for piercing the tap hole of a shaft furnace, with a working member equipped with a universal chuck according to the present invention.

In FIG. 1, a partial side view of the mount 10 of a machine for piercing the tap hole of a shaft furnace is shown. A movable carriage 16 on which a working member is fixed, slides along this mount via a plurality of wheels 12, 14. The support carriage 16 is usually provided with its own drive means (not illustrated), for example, an endless chain driven by a motor. The working member 18 comprises, typically, a member generating a rotational moment, a front hammer and a rear hammer. A spindle 26 serves as an external member for transmitting the rotational moment and the blows produced by the said front hammer and rear hammer. This spindle 26 comprises a threaded end 28 and an axial channel 30 (see FIG. 2) which constitutes a pneumatic fluid supply channel.

A preferred embodiment of the universal chuck 32 in accordance with the present invention can be seen at the front of the carriage 16, in other words, on the spindle 26 side. In particular, a rotary body 34 and a support structure 36 (see FIG. 2) can be seen, the support structure being integral with the carriage 16 and forming a sort of cage around the majority of the rotary body 34.

Figure 2:
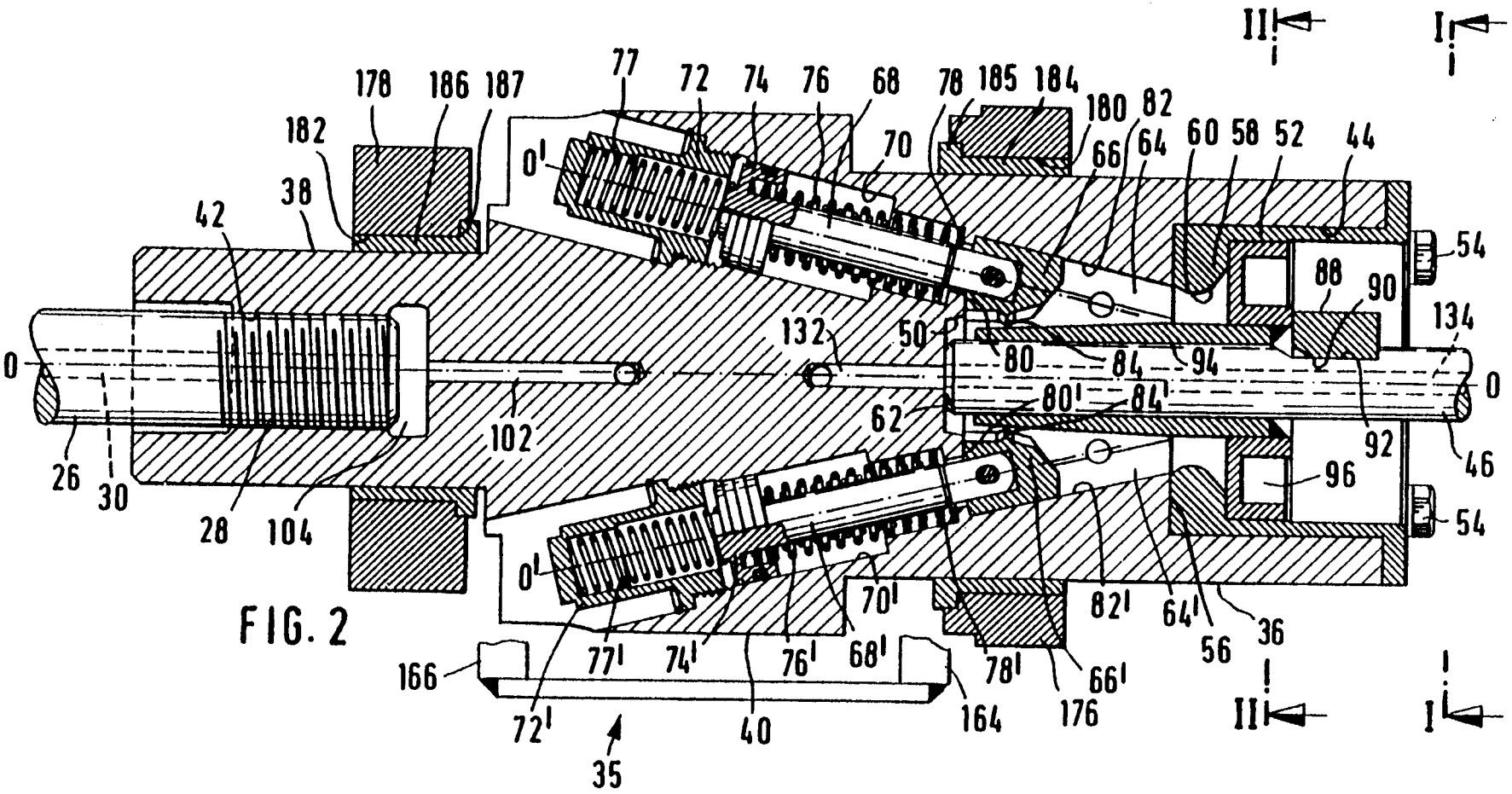
FIG. 2 is a section through a vertical plane through the axis of the universal chuck of the present invention.

The rotary body 34 is a body of revolution which comprises a front cylindrical bearing surface 36 and a rear cylindrical bearing surface 38, which has a slightly greater diameter than the two other cylindrical bearing surfaces (see FIG. 2). The rear cylindrical bearing surface 38 comprises a tapped blind hole 42, produced according to the dictates of the art in line with the axis of revolution O for receiving the threaded end 28 of the spindle 26 of the working member 18.

The front cylindrical bearing surface 36 comprises a first bore 44 coaxial with the axis of revolution O of the rotary body 34. The diameter of this first bore 34 is substantially greater than that of a drill bit 46 or of a rod 48 (see FIG. 1 ) which are to be coupled to the chuck 32. A second bore 50, which is blind, extends the said first bore 44 axially. The diameter of this second bore 50 is only slightly greater than the diameters of the drill bit 46 and the rod 48 (see FIGS. 2 and 4).

In FIG. 2, it can be seen that a bushing 52, which is fixed by screws to the body 34, is fitted into the first bore 44. This bushing 52 comprises a circumferential bead 58 at the bottom 56 of the first bore 44. This bead 58 defines a transition surface 60 between the first large-diameter bore 44 and the second small-diameter bore 50, so as to facilitate the insertion of the end of the rod 48 or of the drill bit 46 into the second bore 50. It will be appreciated that this transition surface 60 could also have been formed directly from the material of the body of revolution 34. A plane surface 62, perpendicular to the axis of revolution 0, forms the bottom of the second blind bore 50. This plane surface 62 serves as an axial bearing point for the drill bit 46 during the drilling, or for the rod 48 when the latter is driven into the plugging compound.

Two recesses 64, 64' (see FIGS. 2 and 4), which are symmetrical relative to a plane passing through the axis of revolution, are formed in the second bore 50. A jaw 66, 66' slides in each recess. Each of these jaws 66, 66' is extended by a rod 68, 68', the axis O' of which preferably forms an angle of between 10 degrees and 20 degrees with the axis of revolution O, in a bore 70, 70' made with the same angle in the central bearing surface 40 of the rotary body 34. This bore 70, 70' is closed axially by a threaded plug 72, 72'. The rod 68, 68' ends in a piston head 74, 74' fitted according to the dictates of the art in the bore 70, 70'. A helical spring 76, 76' mounted between the piston head 74, 74' and a bearing surface 78, 78' retracts, in the absence of a pressurized pneumatic fluid, the rod 68, 68' to the maximum extent into the bore 70, 70'; in other words, until the jaw 66, 66' is immobilized by an axial abutment surface 80, 80' in its recess 64, 64'. The sole purpose of the helical springs 77, 77' mounted in the plugs 72, 72' is to prevent the piston heads 74, 74' from abutting the plugs 72, 72' in the absence of the pneumatic fluid. An inclined surface 82, 82', delimiting each recess 64, 64' radially, serves as a guide surface for the jaws 66, 66' when a pressurized pneumatic fluid is introduced upstream of the pistons 74, 74' in order to advance the jaws 66, 66' from a retracted position to an advanced position.

It will be noted that the jaws 66, 66' are arranged in such a way that, in the retracted position, the distance between the jaws 66, 66' measured perpendicularly to the axis of revolution O is greater than the largest of the diameters of the rods 48 and drill bits 46 which are used, and that in the fully advanced position the said distance is less than the smallest diameter of the rods 48 which are used. The jaws 66, 66' are, moreover, provided in a known manner with a transverse ridge 84, 84' for gripping the piercing rod 48.

Figure 3:
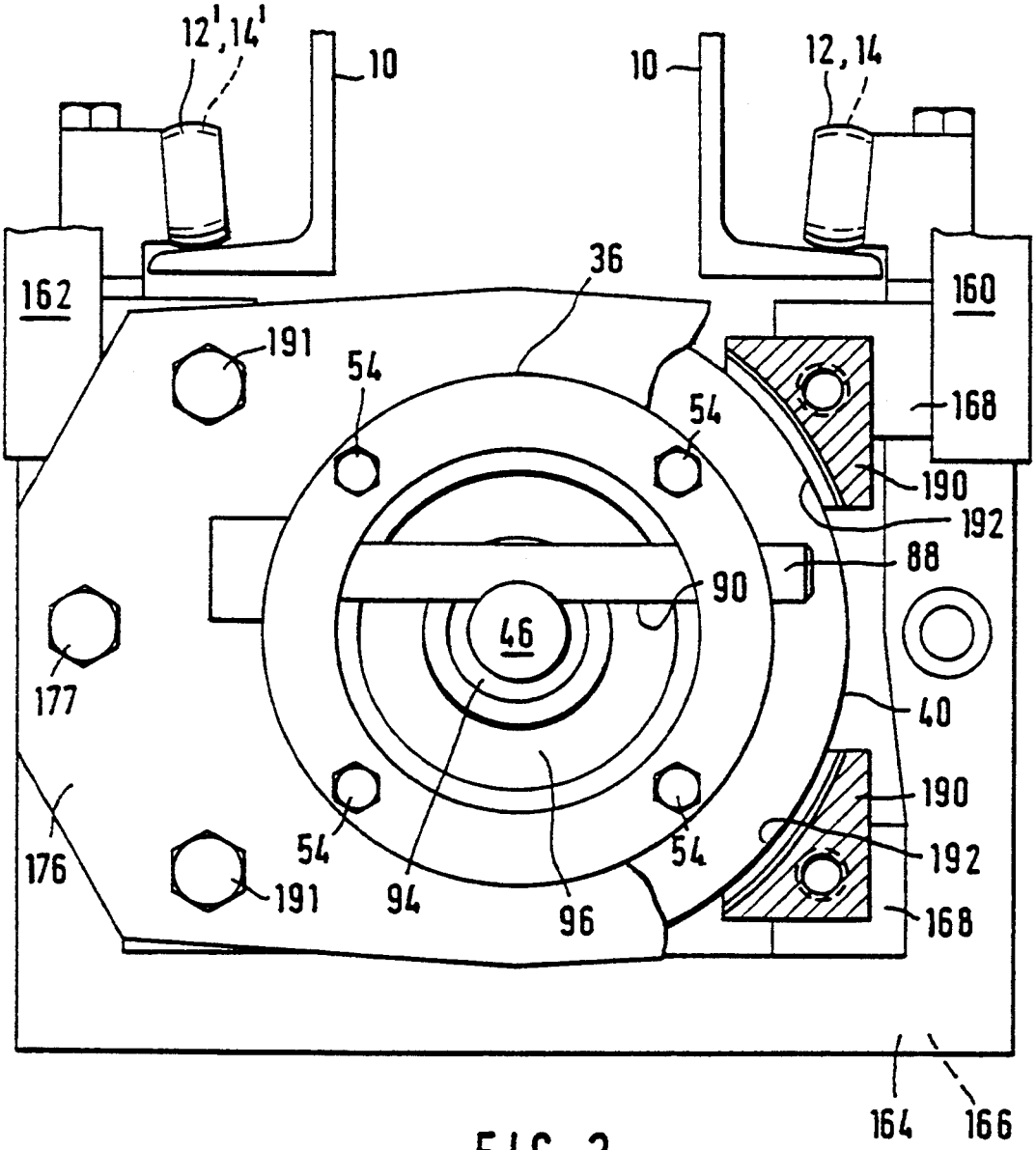
FIG. 3 is a view in the direction of the arrows I—I of the universal chuck in FIG. 2, the front plate being partially sectioned.
Figure 4:
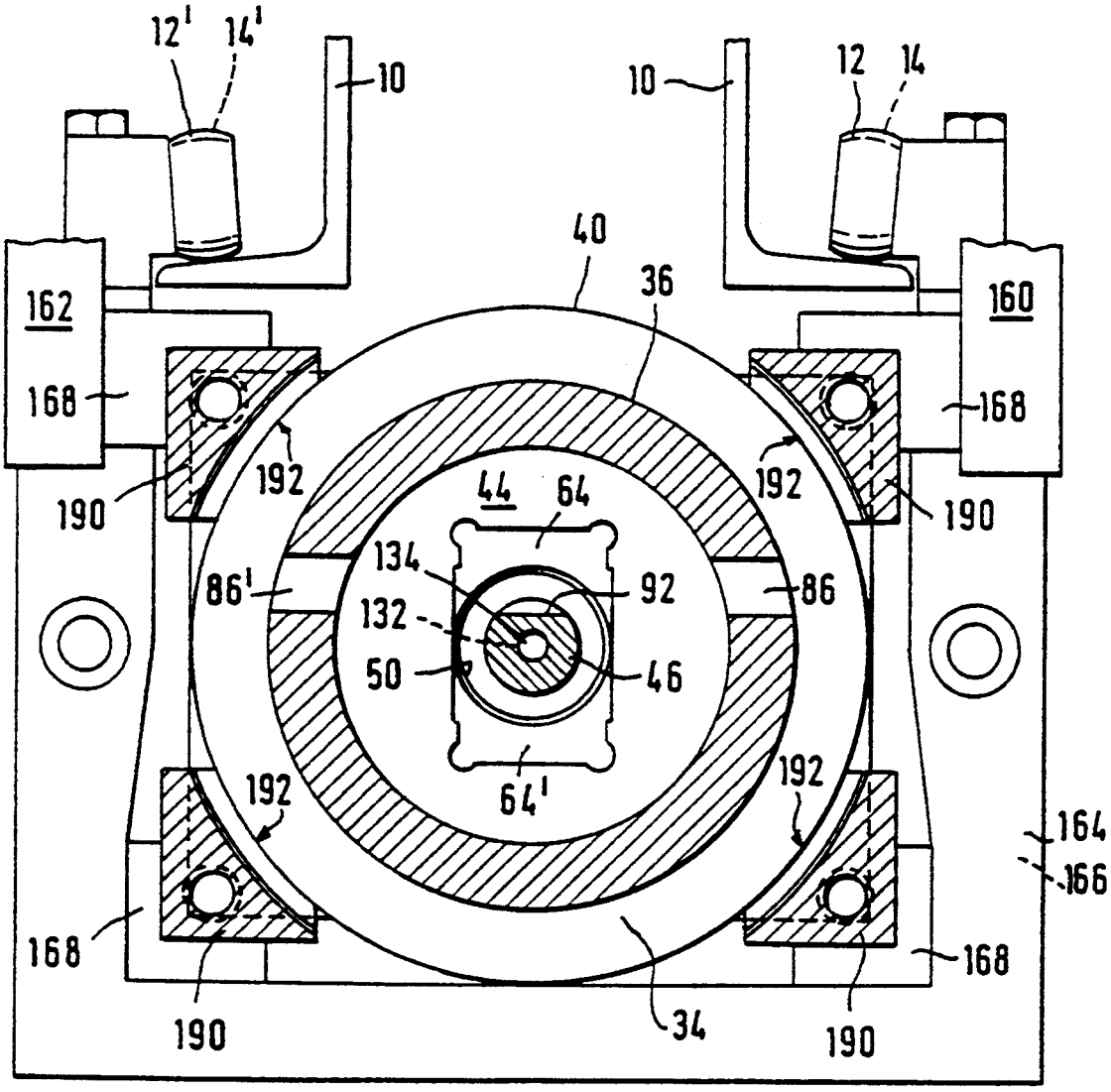
FIG. 4 is a section along the section line II—II of the universal chuck in FIG. 2, certain elements being omitted to permit a view of the inside of the body of the universal chuck.

At the front, in other words, in the first bore 44, the body of revolution 34, which is a hollow cylinder at this point, is equipped, symmetrically to a plane passing through the axis of revolution O, with two grooves 86, 86' (see FIGS. 3 or 4). The latter are arranged in such a way that a transverse key 88, guided in the said grooves 86, 86', comes to bear with the one of its longitudinal surfaces 90 on a flat surface 92 formed in the end of the drill bit 46. The end of the drill bit 46 is thus locked in rotation and axially in the cavity formed by the first bore 44 and the second bore 50.

The reference numeral 94 denominates a removable protective sleeve, the external diameter of which is slightly less than the diameter of the second bore 50 and the internal diameter of which is slightly greater than the diameter of the end of the drill bit 46. This removable protective sleeve 94 is inserted into the second bore 50 so as to immobilize the jaws 66, 66' axially in a retracted position against the beating surface 80, 80' and thus to prevent them from being propelled forwards when the hammer is operating. This sleeve 94 is equipped at one of its ends with a coaxial ring 96, the external diameter of which corresponds to the internal diameter of the bushing 52 (see FIGS. 2 and 3). It will be appreciated that this ring 96 facilitates the insertion of the sleeve 94 into the first bore 50 and allows it to be immobilized axially by the same key 88 which already serves to lock the end of the drill bit 46 in rotation. Furthermore, this ring 96 effectively prevents the penetration of splashes into the recesses 64, 64' of the claws. Indeed, FIG. 4 shows that, in the absence of the protective sleeve 94, the recesses 64, 64' are completely exposed to splashes of molten materials which enter through the bore 44 into the rotary body 34.

The rotary body 34 is also equipped with a system for distributing the pneumatic fluid. A supply channel 102 is formed in the axis of revolution O of the rotary body 34 and opens out into a chamber 104 which is delimited axially on one side by the threaded end 28 of the spindle 26 and on the other side by the bottom of the blind hole 42. It should be remembered that this chamber 104 is supplied by the axial channel 30 formed in the spindle 26. The axial supply channel 102 formed in the rotary body is extended by a radial channel 106 in the direction of a three-way valve 108 formed in the said central bearing surface 40 of the rotary body 34 (see FIG. 5). It will be appreciated that this three-way valve 108 is fully incorporated into the said rotary body 40.

In a first preferred embodiment (see FIG. 5), this three-way valve comprises a cylindrical piston 110 which can slide in a blind bore 112 formed, for example, parallel to the axis of revolution O, in the central cylindrical bearing surface 40. A plug 114 screwed into the tapped opening 116 of the bore 112 delimits the bore 112 axially. The cylindrical piston 110 terminates in a coaxial rod 118 of a smaller diameter than the piston 110. This rod 118 traverses the plug 114 in order to extend the piston 110 outwards and thus to serve as a control member for the three-way valve. Immediately behind the plug 114 there is formed in the bore 112 a first cylindrical chamber 120 into which opens a first distribution channel 122 which supplies the two actuators of the jaws 66. At the opposite end of the bore 112, a second distribution channel 124 opens out into a second chamber 126 defined in the bore 112 and limited axially on the other side by a shoulder 130 of the piston 110. This second channel 124 is oriented radially toward the axis of revolution 0, where it is extended by an axial channel 132 as far as the second axial bore 50. Here this axial channel opens out into the said end plane surface 62. The object of this second channel 132 is to connect the end of the drill bit 46 to the circuit for supplying the pneumatic fluid in order to be able to distribute this fluid through a channel 134 formed axially in the said drill bit 46 as far as the head of the latter, where this fluid serves as a rinsing fluid and a cooling fluid.

The channel for supplying the pneumatic fluid 106 has its opening 107 in the central part of the bore 112. The cylindrical piston 110 is equipped with an axial bore 136 which opens out in the region of the rod 118 into a cylindrical chamber 138 formed in the plug 114 and which is connected axially to the chamber 120 into which the first distribution channel 122 opens out. At the other end of the piston 110, the bore 136 opens out axially into the cylindrical base of the piston 110. A longitudinal depression 140 is formed in the piston 110 in the region of the opening 107 of the supply channel 106. This depression 140 is extended by a radial bore 142 in the axial bore 136 of the piston 110. Circumferential seals 144, 146 situated on either side of this depression 140, prevent axial leaks between the piston 110 and the bore 112 into the first chamber 120 or the second chamber 126, respectively.

On the first distribution channel 122 side, the sealing of the connection between this channel 122 and the supply channel 106 takes place at a shoulder surface 148 of the piston 110 and a front annular surface 150 of the threaded plug 114. The shoulder surface 148 of the piston is equipped with an annular seal 152. When the piston 110 is displaced axially towards the plug 114, the shoulder surface 148 abuts the front annular surface 150 of the plug, sealing the cylindrical chamber 138, with respect to the cylindrical chamber 120 into which the first distribution channel 122 opens out.

The sealing of the connection between the supply channel 106 and the second distribution channel 124 takes place at the cylindrical base of the piston and the plane end surface which delimits the bore axially. For this purpose, the annular base 154 of the piston is equipped with an annular seal 156. When the piston 110 is pushed axially into the bore 112, it first opens the connection between the supply channel 106 and the first distribution channel 122 via the axial bore 136, the chamber 138 formed in the plug 114 and the first chamber 120 into which the first distribution channel opens out. At the end of its travel, the cylindrical base 154 of the piston abuts the planar surface of the bottom 128 of the bore. This contact seals the connection between the supply channel 106 and the second distribution channel 124 via the axial bore 136 and the second cylindrical chamber 126 into which the second distribution channel 124 opens out.

Figure 5:
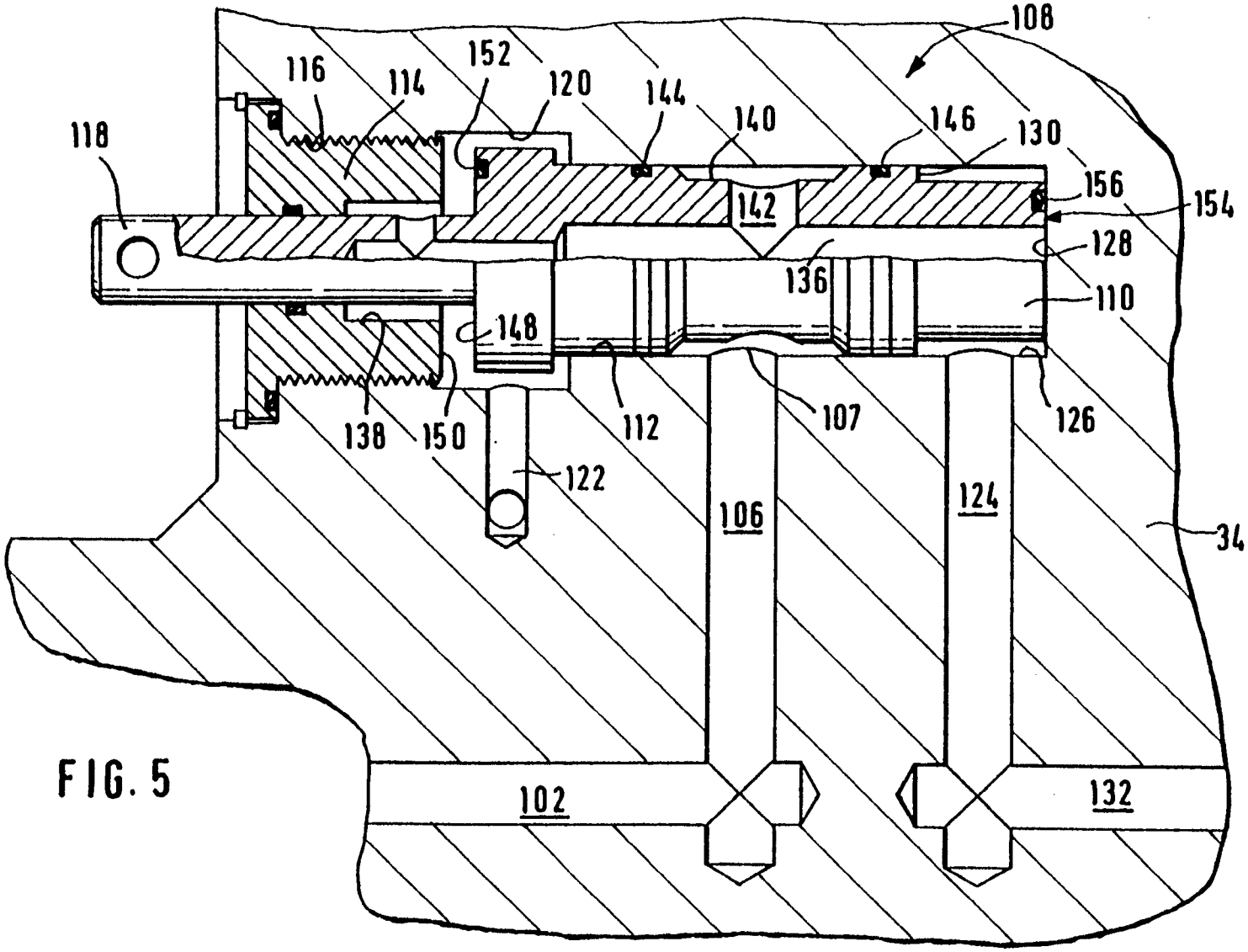
FIG. 5 is a section through a first embodiment of a three-way valve incorporated into the universal chuck of FIG. 2.
Figure 6:
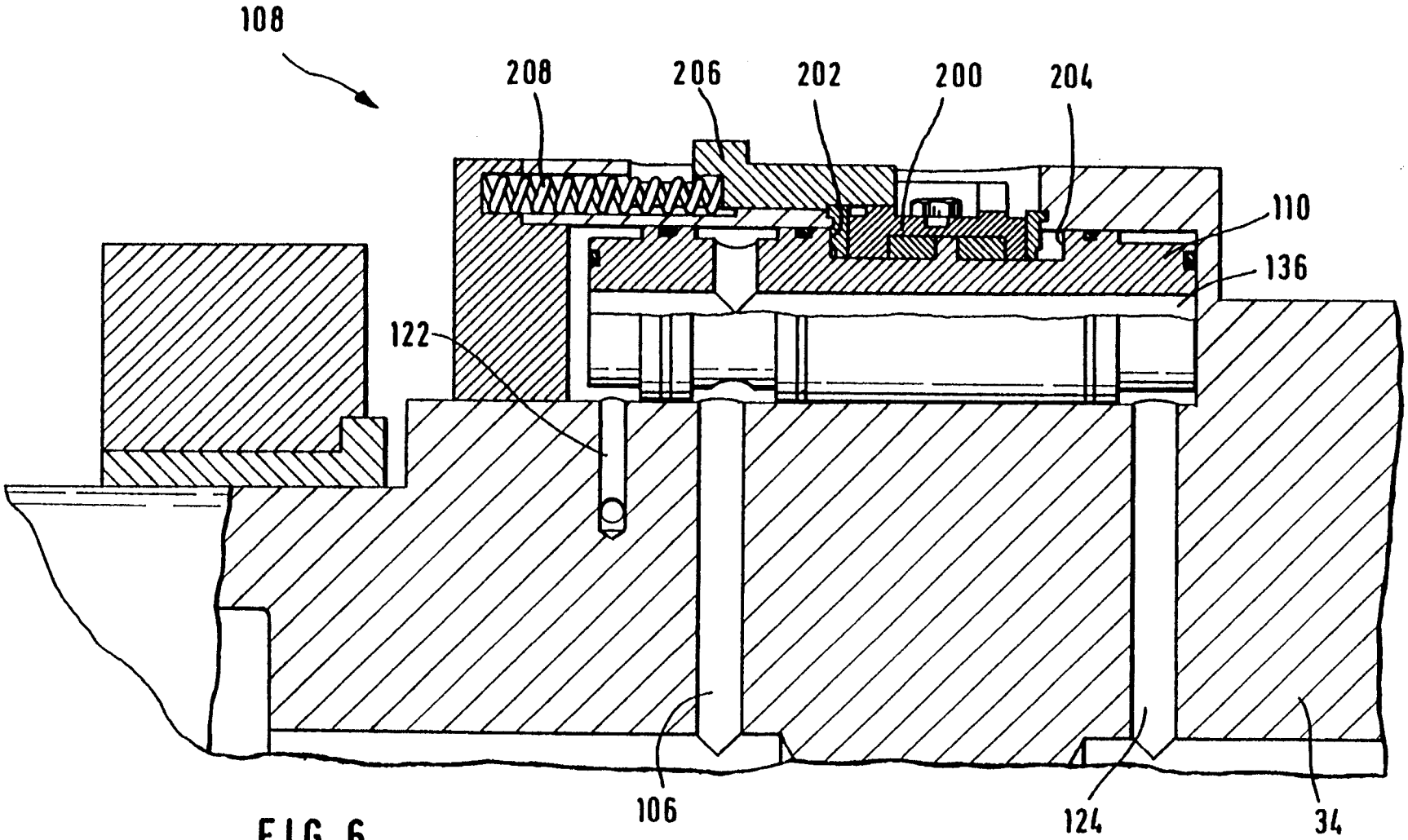
FIG. 6 is an alternative embodiment of the valve shown in FIG. 5.

FIG. 6 illustrates an alternative embodiment of the three-way valve of FIG. 5. Instead of being actuated by a rod 118 which axially extends the piston 110, the three-way valve is actuated in the alternative shown in FIG. 6 by an eccentric disc 200 which bears either on a first shoulder 202 or on a second shoulder 204, which shoulders are formed in the piston 110. A catch 206 equipped with a spring 208 forms a means for immobilizing the disc 200 and consequently the three-way valve 108 is either in the first position or is in the second position.

Figure 7:
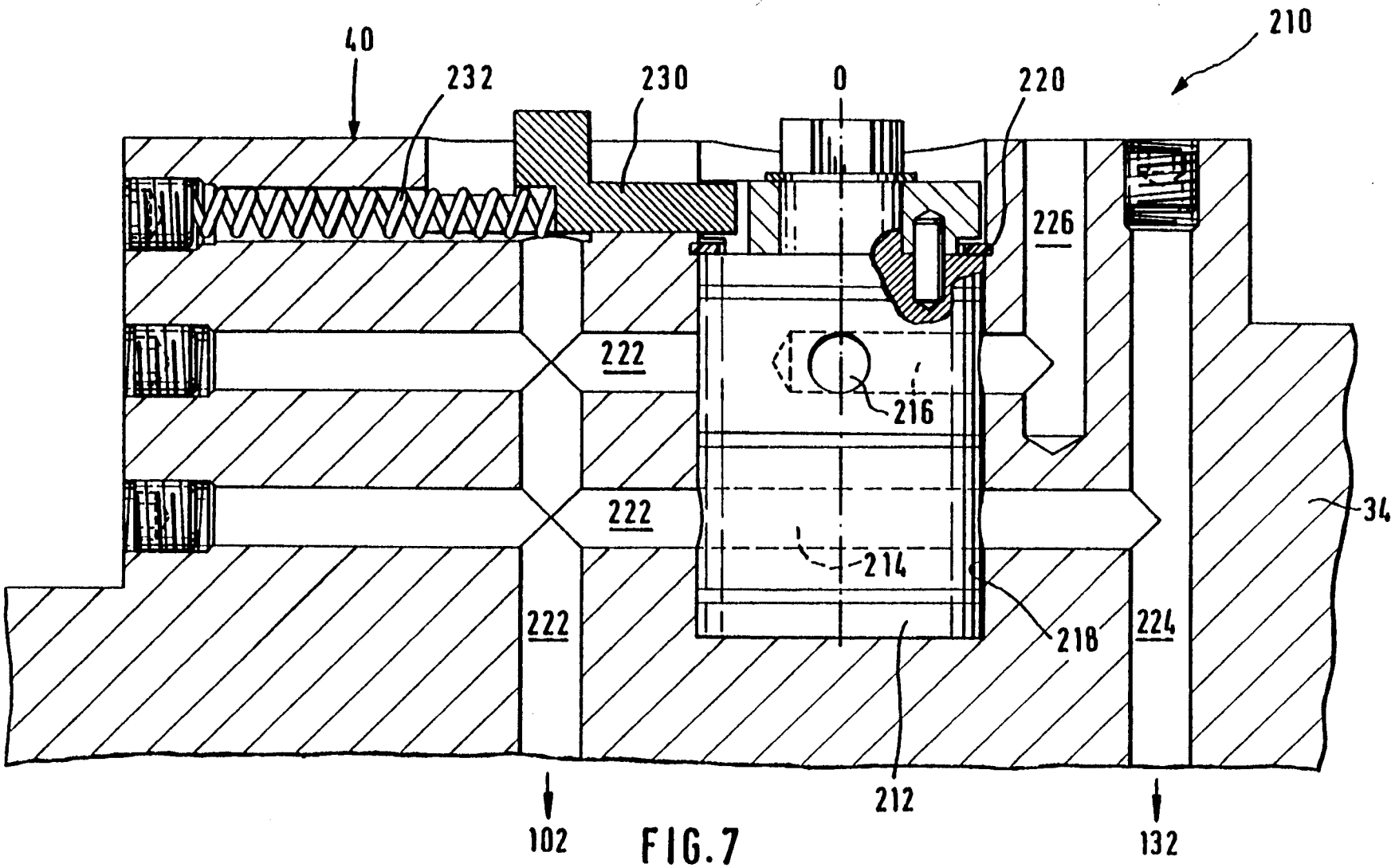
FIG. 7 is a section through a second embodiment of a three-way valve incorporated into the universal chuck of FIG. 2.

FIG. 7 illustrates a different alternative embodiment of the three-way valve of FIG. 5. This valve 210 comprises a rotary cylinder 212 equipped with a first channel 214 formed by a diametrical bore and a second channel 216 formed by two radial bores at right angles to each other. The cylinder is fitted into a blind bore 218 preferably made perpendicular to the axis of revolution 0, in the central cylindrical bearing surface 40. A resilient ring 220 holds the cylinder 2 14 in this bore 218 while at the same time allowing it to rotate about its axis of revolution O. In a first position, the channel 214 connects an arm 222 of the supply channel 102 to an arm 224 of the channel 132 which supplies the drill bit, and the channel 216 connects the channel 122 supplying the actuators of the jaws 66, 66' to the open air via a channel 226. In a second position, in other words after the cylinder 212 has been rotated by 90 degrees in a clockwise direction, the channel 214 no longer connects the arm 222 of the supply channel 102. A catch 230 equipped with a spring 232 serves to immobilize the cylinder 212 in the two positions.

The rotary body 34 described above is supported and guided radially by the support structure 36 integral with the sliding carriage 16 (see FIG. 1) which in turn supports the working member 18. Two bars 160, 162 with a rectangular cross-section extend the sliding carriage 16 on each side of the mount 10, jutting out from the sliding carriage 16 on the side on which the spindle 26 is situated. The two bars 160, 162 are connected at their free end transversely by a first rectangular frame 164 and a second rectangular frame 166. These frames 164, 166 are spaced apart axially and are connected in this same direction by an angle bar 168 at each of the four comers (see FIG. 4). These angle bars 168 define, between the first frame 164 and the second frame 166, the four ridges of a prismatic space of square cross-section, the longitudinal axis of which coincides with the axis of rotation O of the spindle 26.

A first plate 176 is fixed to the first frame 164 and a second plate 178 is fixed to the second frame 166 in such a way as to delimit the said prismatic space axially (see FIG. 2). The first plate 176, in other words, the one furthest from the spindle 26, is fixed by bolts 177 to the front face of the first frame 164 (see FIG. 3). The second plate 178 can be bolted or welded to the front face of the second frame 166.

A bore 180 is made in the first plate and a bore 182 is made in the second plate, the bores being coaxial with the axis 0 (see FIG. 2). Each of these two bores 180 and 182 is equipped with a sleeve 184, 186 which is preferably equipped with a shoulder 185, 187 which bears against the inner surface of the first plate 176 and the second plate 178, respectively. These sleeves 184, 186 can be mounted either by bolting, shrinking-on, adhesive or by any other appropriate mounting method. The internal diameter of the sleeve 184 mounted in the first plate 176 corresponds to the diameter of the first cylindrical bearing surface 36 of the rotary body 34. The internal diameter of the sleeve 186 mounted in the second plate 178 corresponds to the diameter of the second cylindrical bearing surface 38. The diameters are selected in such a way as to permit rotation of the rotary body 34 under the effect of the rotation member 29 (not shown), and sliding of the latter in an axial direction under the effect of the hammer 22, 24 (not shown) taking into account that the piercing machine must operate under severe conditions. It should be noted that on a piercing machine the rotational speed corresponds to approximately 150 revolutions per minute and the distance travelled in the sliding movement corresponds to approximately 5 cm.

The central cylindrical bearing surface 40 of the rotary body 34 is guided by four slides 190 which are fixed, for example, by bolts to the four angle bars 168. Alternatively, the four slides 190 may also be fixed by bolts 191 to the plates 176, 178, which makes them easier to disassemble. Each of these slides 190 has, of course, a sliding surface of the central bearing surface 40 of the rotary body 34 over a longitudinal angular segment.

It is clear to a person skilled in the art that the present invention could also be implemented with the support carriage 16 of the working member 18 being equipped with a support structure comprising a rugged bushing, the longitudinal axis of which would coincide with the axis of the spindle. This bushing could then support a cylindrical rotary body having a constant diameter over its entire length (an alternative embodiment not shown in the FIGURES).

It will, however, be appreciated that the embodiment of the chuck described hereinbefore has the advantage of relatively simple construction, facilitates replacement and maintenance of the rotary body and the sliding surfaces, and assures good absorption of offset forces with respect to the axis of the spindle. In addition, low resistance to the running and sliding of the rotary body 34 in the support structure 36 is achieved by this invention.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A universal chuck for a machine for piercing a tap hole of a shaft furnace, the piercing machine comprising a working member equipped with a spindle defining a longitudinal axis "0", said working member being mounted on a sliding carriage of the piercing machine and being capable of generating at least a rotational moment about the axis "0" and a percussive/tensile force along the axis "0", said universal chuck comprising:

an oblong body equipped at one end with means for making the oblong body axially integral with the spindle and at the opposite end, equipped with a front cavity arranged about the axis "0" for the insertion therein of one end of a drill bit or a piercing rod;

first gripping means for gripping the end of a piercing rod in said cavity, said first gripping means enabling said percussive/tensile force to be transmitted to a piercing rod;

immobilizing means for immobilizing the end of a drill bit in said cavity, said immobilizing means enabling a rotational moment to be transmitted from the chuck to a drill bit;

said first gripping means and said immobilizing means being arranged in said oblong body about said front cavity;

a rigid support structure rigidly attached to said sliding carriage and extending along said oblong body; and said support structure having at least one bearing which supports and guides said oblong body radially, permitting at the same time a rotational movement about the axis "0" and a relative sliding movement of said oblong body.

2. The device of claim 1 wherein said first gripping means transmitting said tensile force to the piercing rod or drill bit comprises at least two movable jaws arranged symmetrically about the axis "0", said movable jaws being capable of being displaced, under the action of actuators supplied with a pneumatic fluid between a retracted position in which the distance between a retracted position in which the distance between the jaws, measured perpendicularly to the axis "0", is greater than the largest of the diameters of the piercing rod or drill bit, and an advanced position in which said distance is less than the diameter of the piercing rod or drill bit.

3. The device of claim 2 wherein the longitudinal axes of the actuators form an angle of between 10 degrees and 20 degrees with the axis "0".

4. The device of claim 2 including helical springs mounted in said actuators, the action of said spring being opposed to the action of the pressurized pneumatic fluid supplying these actuators.

5. The device of claim 1 wherein said immobolizing means transmitting said rotational moment to a drill bit comprises a transverse key housed in transverse grooves in said oblong body, said transverse key interacting with a flat surface formed in the end of a drill bit to lock the drill bit in rotation in said cavity.

6. The device of claim 2 wherein a removable sleeve is inserted axially into said cavity to immobilize said jaws in the retracted position against an abutment.

7. The device of claim 5 wherein said sleeve comprises a coaxial ring at one of its ends which seals said cavity about the drill bit radially and the same said drill bit is immobilized axially therein by said transverse key.

8. The device of claim 1 wherein said rigid support structure forms a cage surrounding said oblong body over the majority of its length, said cage comprises a front plate and a rear plate, each plate being equipped with a sleeve, and said body being equipped with a cylindrical bearing surface which is coaxial with the axis "0".

9. The device of claim 8 wherein said front plate is attached to said cage by fastener means which can be removed to extract said rotary body from said cage.

10. The device of claim 8 including four slides mounted between said front plate and said rear plate and a third cylindrical bearing surface of said oblong body, which bearing surface is coaxial with the axis "0", said third cylindrical bearing surface having a larger diameter than the other two cylindrical bearing surfaces, said slides guiding this central cylindrical bearing surface radially.

11. The device of claim 2 wherein the said rotary body comprises:

a supply channel for the pneumatic fluid connected to a supply channel in the spindle;

a first channel for distributing the pneumatic fluid to the actuators of the jaws;

a second channel for distributing the pneumatic fluid which opens out axially into a surface of the said cavity on which the shank end of a drill bit bears; and a three-way valve incorporated into said rotary body enabling said pneumatic supply duct to be connected either to said first distribution channel or to said second distribution channel.

12. The device of claim 11 wherein:

the three-way valve comprises a cylindrical piston which can slide axially between a first position and a second position in a bore made in said body, the piston being equipped with an axial bore connecting said supply channel in said first position to a first chamber into which the first distribution channel opens and, in said second position, to a second chamber into which the second distribution channel opens.

13. The device of claim 11 wherein:

the three-way valve comprises a cylinder which can be rotated about its axis "0" in a bore made in said body between a first position and a second position, the cylinder being equipped with inner channels connecting said supply channel in the first position to the first distribution channel and in the second position to the second distribution channel.

* * * * *